US006032496A

United States Patent [19]

Weyerstall et al.

[11] Patent Number: 6,032,496

[45] Date of Patent: Mar. 7, 2000

[54] DOOR LOCK ARRANGEMENT FOR MOTOR VEHICLES

[75] Inventors: Bernd Weyerstall, Wuppertal; Bernhard Kordowski, Dortmund, both of Germany

[73] Assignee: Robert Bosch GmbH, Stuttgart, Germany

[21] Appl. No.: 09/116,250

[22] Filed: Jul. 16, 1998

[30] Foreign Application Priority Data

Jul. 18, 1997 [DE] Germany ..... 197 30 869
Sep. 30, 1997 [DE] Germany ..... 197 43 128

[51] Int. Cl.[7] ..... E05B 63/00

[52] U.S. Cl. ..... 70/1.5; 70/416; 70/422

[58] Field of Search ..... 70/1.5, 1.7, 416, 70/379 R, 380, 422

[56] References Cited

U.S. PATENT DOCUMENTS

| | | | |
|---|---|---|---|
| 3,597,949 | 8/1971 | Nigrelli | 70/1.5 |
| 3,783,655 | 1/1974 | Giannetto | 70/1.5 |
| 3,961,504 | 6/1976 | Sprecher | 70/1.5 |
| 4,413,493 | 11/1983 | Meinsen et al. | 70/422 |
| 4,426,858 | 1/1984 | Interrante | 70/1.5 |
| 4,565,994 | 1/1986 | Mochida et al. | 70/1.5 |

FOREIGN PATENT DOCUMENTS 36 28 376 2/1988 Germany .

38 27 564 5/1989 Germany .

*Primary Examiner*—Teri Pham

*Attorney, Agent, or Firm*—Sixbey, Friedman, Leedom & Ferguson; David S. Safran

[57] ABSTRACT

A door lock arrangement for motor vehicles with a closing cylinder arrangement (2) attached to outer sheet metal (1) of the body of a vehicle so as to be accessible from the outside and with a lock mechanism (5) attached in the body to be inaccessible from the outside. On the closing cylinder arrangement (2) there is transfer element (6) which establishes the connection of closing cylinder arrangement (2) to the lock mechanism (5). A corresponding coupling element (7) on the lock mechanism (5) engages the transfer element (6) by form-fit such that rotary motion of transfer element (6) is converted into a corresponding rotary motion of the coupling element (7). To secure against illicit penetration into the interior of the motor vehicle, it is provided that, upon forced removal of closing cylinder arrangement (2), the transfer element (6) is entrained by the closing cylinder arrangement (2) so that the coupling element (7), after forced removal of transfer element (6), is destroyed or otherwise modified such that it can no longer be actuated from the outside for purposes of opening the lock mechanism or such that the forced removal of the closing cylinder arrangement (2) triggers an anti-theft system (alarm system).

10 Claims, 2 Drawing Sheets

DOOR LOCK ARRANGEMENT FOR MOTOR VEHICLES

BACKGROUND OF THE INVENTION

1. Field of the Invention

The invention relates to a door lock arrangement for motor vehicles, for example, for a rear door or sliding door of a motor vehicle or for a rear hatch, and in the extreme case, also for a hood, of the type having a closing cylinder arrangement attached to outer sheet metal of the vehicle body so to be accessible from the outside, and a lock mechanism attached in the body so to be inaccessible from the outside. In particular to such a lock arrangement in which a closing cylinder arrangement has a transfer element which establishes the connection of closing cylinder arrangement of the lock mechanism, the transfer element making a form-fit engagement with a corresponding coupling element on the lock mechanism, such that rotary motion of the transfer element is converted into a corresponding rotary motion of the coupling element.

2. Description of Related Art

Door lock arrangements for motor vehicle doors are known in a host of embodiments. For this invention, the prerequisite is that the door lock arrangement, in the vehicle body, has a lock mechanism which is attached so as to be inaccessible from the outside and which, however, can be actuated from the outside via a closing cylinder arrangement. The closing cylinder arrangement on the outer sheet metal of the body, whether on the motor vehicle door or on the outside sheet metal of the frame, is attached to be accessible from the outside. Interesting examples of such arrangements can be found in published German Patent Application No. DE - A - 36 28 376 and in German Patent No. DE - C - 38 27 564.

A transfer element is used to transfer the adjustment motion of the closing cylinder arrangement into the lock mechanism. It can be learned, for example, from published German Patent Application No. DE - A - 36 28 376, how this closing cylinder arrangement is mounted on the finished vehicle. Generally, the lock mechanism is already located permanently in its location in the body of the motor vehicle, the closing cylinder arrangement is joined to the body from the outside and is screwed in turn from the inside to the body. The joining results in the transfer element of the closing cylinder arrangement engaging a coupling element corresponding thereto on the lock mechanism so that, in the mounted state, the two elements engage one another by form-fit. Very often the coupling element is attached to rotate in its bearing around its own longitudinal axis and is caused to axially engage the transfer element by form-fit. This coupling element is called a nut. This nut can be made in one part (published German Patent Application No. DE - A - 36 28 376) or in two parts, consisting of an outer nut and an inner nut (German Patent No. DE - C - 38 27 564). A two-part nut has special advantages with respect to the transfer of adjustment movements into the lock mechanism and the actuation of switches partially independent therefrom for control functions.

The above described door lock arrangements for motor vehicles have been known for a long time in different embodiments and have proven effective. Increasingly motor vehicles are equipped with antitheft systems. On the one hand, there are mechanical components for implementing the antitheft functions of the individual door lock arrangements, and on the other hand, there is alarm triggering when the door lock arrangements are actuated illicitly.

Recently, there have been more and more motor vehicle thefts in which the car thief removes the closing cylinder arrangement from the outside sheet metal of the body by force. The thief then reaches the transfer element, or if the transfer element is entrained by the closing cylinder arrangement, in the forced removal of the closing cylinder arrangement. If it was actuated properly from the closing cylinder arrangement, the coupling element on the lock mechanism can be actuated with a corresponding tool from the outside. Thus, the circuit of the antitheft system (alarm system) does not recognize that forced penetration into the interior of the motor vehicle is taking place here and there is no alarm.

SUMMARY OF THE INVENTION

The object of the present invention is to improve upon the known, above explained door lock arrangement such that, with forced removal of the closing cylinder arrangement, access to the interior of the motor vehicle is not possible without triggering the alarm system.

The above described object is achieved in a door lock arrangement of the initially mentioned type by the transfer element being entrained by closing cylinder arrangement upon forced removal of closing cylinder arrangement in a manner causing the coupling element to be destroyed or otherwise modified after forced removal of transfer element such that it can no longer be actuated from the outside for purposes of opening of the door lock, or that forced removal of the closing cylinder arrangement can trigger the anti-theft system (alarm system). The forced removal of the closing cylinder arrangement leads first to the transfer element being entrained. Entrainment of the transfer element with the closing cylinder arrangement results in the fact that access to the lock mechanism is already difficult because it is necessary to reach deep into the interior of the body in order to reach the coupling element on the lock mechanism. This would not be anything special, and is already the case in some areas in known door lock arrangements. It is important that, by forced removal of the transfer element from the coupling element, the coupling element is destroyed so that it can no longer be actuated at all. One preferred alternative consists in that the coupling element after forced removal of the transfer element is modified such that it can no longer be actuated from the outside for the purposes of the opening function of the door lock arrangement. Finally, a third alternative consists in that forced removal of the closing cylinder arrangement triggers the antitheft system (alarm system), therefore a corresponding switching function takes place.

The three above described alternatives for achieving the object of the invention can be effected in a plurality of different embodiments or all incorporated into a single embodiment. These embodiments and other preferred embodiments and developments of the teaching of the invention are discussed in detail below using an explanation of two simply preferred embodiments in conjunction with the drawings.

DETAILED DESCRIPTION OF THE PREFERRED EMBODIMENTS

Figures 1A, 1B, 1C:
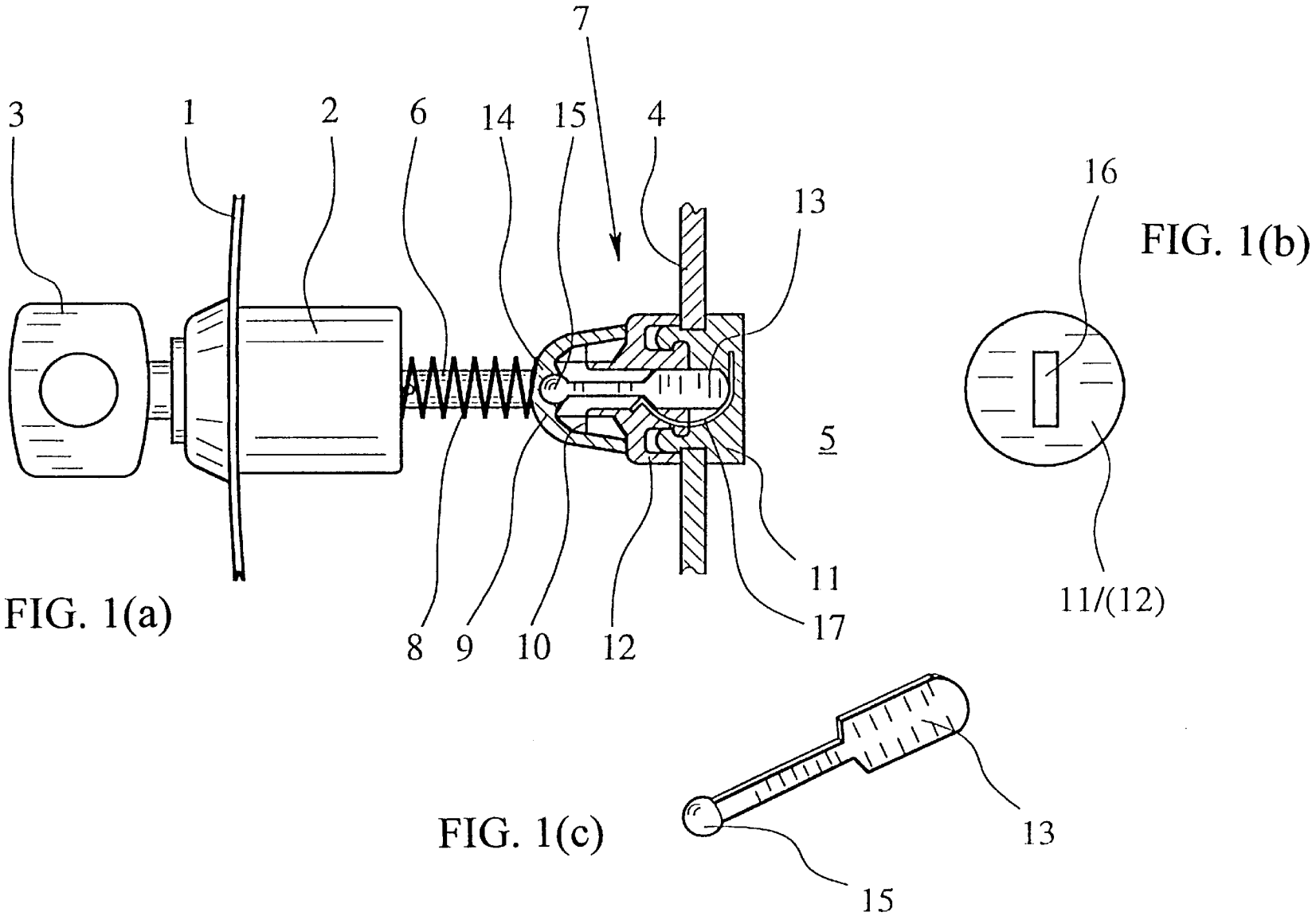
FIG. 1*a* schematic depiction a first embodiment of a door lock arrangement for a motor vehicle.
FIG. 1*b* is an end view an opening of the coupling element of FIG. 1*a* for receiving the connecting paddle of FIG. 1*c*.
FIG. 1*c* is a connecting paddle of the coupling element of FIG. 1*a*.

FIG. 1*a* shows a door lock arrangement for motor vehicles which, as has been explained initially, can be used not only for side doors of motor vehicles, but also for rear doors, rear hatches, sliding doors or even hoods. The components shown can be located on a movable element of the body, therefore, for example, a side door; but, they can equally well be located on the stationary door frame of the body, for example, as are often encountered in rear hatches.

The door lock arrangement shown in FIG. 1*a* for motor vehicles, first, has a closing cylinder arrangement 2 attached to outside sheet metal 1 of the body (this can be the door sheet metal or the door frame sheet metal) to be accessible from the outside. A key 3 is shown inserted into the closing cylinder arrangement 2. A portion of a support plate 4 (support sheet metal) located in the body is also shown; part of lock mechanism 5 is attached to this support plate 4 so as to be inaccessible from the outside of the body or is permanently joined thereto.

FIG. 1*a,* furthermore, shows a transfer element 6 which is attached to the closing cylinder arrangement 2 and which establishes the connection of the closing cylinder arrangement 2 to the lock mechanism 5. The coupling element 7 on lock mechanism 5 has a shape which corresponds to that of the opposite end of the transfer element 6 so that the transfer element 6 engages the coupling element 7 by a form-fit connection such that rotary motion of key 3, via this transfer element 6, is converted into a corresponding rotary motion of coupling element 7. Rotary motion of the coupling element 7 is transferred into lock mechanism 5 and leads to locking or unlocking of the motor vehicle door lock, as is extensively known from the prior art, and thus, need not be explained or shown specifically.

Here, it is significant that, upon forced removal of closing cylinder arrangement 2, transfer element 6 is entrained by closing cylinder arrangement 2 and that coupling element 7 after forced removal of transfer element 6 is destroyed or otherwise modified such that it can no longer be actuated from the outside for purposes of performing its lock opening function. Alternatively, it can be provided that forced removal of the closing cylinder arrangement 2 triggers the anti-theft system (alarm system), not shown here, and therefore, there is a corresponding switching function. The intention of a car thief to acquire access to lock mechanism 5 by forced removal of closing cylinder arrangement 2, as if he had a key 3 which fits, is thus frustrated.

In particular, it is provided in the embodiment shown in FIG. 1*a* that the transfer element 6 is made as a straight revolving rod. This corresponds roughly to the embodiment of published German Patent Application No. DE - A - 36 28 376. To the revolving rod which forms the transfer element 6, is assigned a compression spring 8 which elastically prestresses a nut funnel 9 located on the end of transfer element 6 in the direction toward the facing end of transfer element 6. Alternatively, coupling element 7, itself, as known from the prior art, could be made in a funnel shape on the side facing transfer element 6. The funnel shape of nut funnel 9 is intended to facilitate bringing together transfer element 6 with coupling element 7 when closing cylinder arrangement 2 is installed.

In the embodiment shown, it is provided that the coupling element 7 is made as a nut which can be turned around its own longitudinal axis in a bearing and which has form-fitted receiver 10 for the transfer element 6 in the embodiment shown for funnel nut 9. The form-fit receiver 10 with which a form-fit element of funnel nut 9 engages is only generally represented in FIG. 1*a*.

The prior art shows, as explained at the beginning, one-part nuts and two-part nuts as coupling elements. The embodiment shown in FIG. 1*a* uses a two-part nut as the coupling element 7 and is, therefore, composed of an inner nut 11 which is connected into the lock mechanism 5 and an outer nut 12 which is coupled to it and which is to be connected to transfer element 6. Inner nut 11 and outer nut 12 can turn freely relative to one another. In this embodiment, inner nut 11 and outer nut 12, however, are torsionally joined to one another, using transfer element 6, in a manner which eliminates their ability to rotate relative to each other.

In the normal operating state, the connection of inner nut 11 and outer nut 12, optionally with inclusion of a certain backlash connection between the two which is used to generate a switching function, of course, is necessary to transfer the rotary motion of the outer nut 12 ultimately to inner nut 11, and thus, into the lock mechanism 5 to generate the desired locking or unlocking.

In the embodiment shown, a so-called paddle 13 (FIG. 1*c*) has a flattened connection part which enters the rectangular center opening of inner nut 11, that is shown on the right in FIG. 1*a,* is used to torsionally connect the outer nut 12 to the inner nut 11 in a way that will prevent them from rotating relative to each other.

In the embodiment shown, it is provided that the paddle 13 is inserted into the coupling element 7 beforehand so as torsionally connect the inner nut 11 and outer nut 12 to one another. By inserting the closing cylinder arrangement 2 into the outer sheet metal 1 of the body, the nut funnel 9 is not only coupled to the outer nut 12 via the form-fit receiver 10 so as to preclude relative rotational displacement between them, but also engages, by locking, the catch receiver 14 with the catch head 15 of paddle 13, in the embodiment shown.

If closing cylinder arrangement 2, which is locked, is pulled in the longitudinal direction for purposes of forcibly removing it from the sheet metal 1 of the body, at the same time, the transfer element 6 pulls the paddle 13 out of the coupling element 7 in the longitudinal direction. Outer nut 12 and inner nut 11, which form coupling element 7, remain within the body.

Without an additional measure, it would now be possible to reach the rectangular opening 16 shown in FIG. 1*b* on the right in inner nut 11, for example, with the blade of a screwdriver. But, this is now prevented by a protection element 17 in the form of a leaf spring which is attached within inner nut 11 in the embodiment shown. In pre-mounting paddle 13, it is inserted into the opening 16 and the leaf spring which forms protection element 17 is pressed to the side and tensioned. If the paddle 13 is withdrawn in the longitudinal direction upon forced removal of closing cylinder arrangement 2, the leaf spring which forms protection element 17 snaps over opening 16 and makes it entirely inaccessible. Since everything takes place in the inner area between outer nut 12 and inner nut 11, protection element 17 is not accessible from the outside either. In this case, the outer nut 12 can then turn freely relative to inner nut 11 due to the lack of the torsional connection produced by paddle 13, and the actuating function of inner nut 11 no longer takes place. The motor vehicle cannot be opened and the door lock arrangement cannot be unlocked.

The embodiment shown in FIG. 1 shows, as described above, that the leaf spring which forms protection element 17 is located in inner nut 11; however, the leaf spring covers the opening 16 in outer nut 12. The form-fit connection between paddle 13 and opening 16 in outer nut 12 in this case is located only in the innermost area of outer nut 12, therefore, near inner nut 11, and with the leaf spring snapped beforehand, within the leaf spring which forms protection element 17. In this sense, "outside" of the leaf spring, the outer nut 12 is provided in the center simply with a circular opening on which a force cannot be applied.

The leaf spring which forms protection element 17 can also be located exclusively in outer nut 12, in which case it would be easily guaranteed, by itself, that outer nut 12 can turn freely relative to inner nut 11 in the absence of paddle 13.

For a one-part nut as coupling element 7, for example, it would be possible that, upon forced removal of closing cylinder arrangement 2, side carrier projections which are provided with scoring in the axial direction with respect to the load which does not occur during operation tear out, so that it is no longer possible to apply force to coupling element 7.

Another possibility is that coupling element 7 is completely torn out of its holder on lock mechanism 5, is otherwise coupled to this lock mechanism 5 only via one plug connection, and this plug connection is dissolved in this case. Then again, actuation of lock mechanism 5 is no longer possible.

Also with respect to the third alternative, different versions are conceivable. For example, it is possible to assign a microswitch to coupling element 7 which is switched when transfer element 6 is inserted to engage coupling element 7 by form-fit. When the transfer element 6 is pulled out upon forced removal of closing cylinder arrangement 2, then the switch is activated again and triggers the alarm system.

Figure 2:
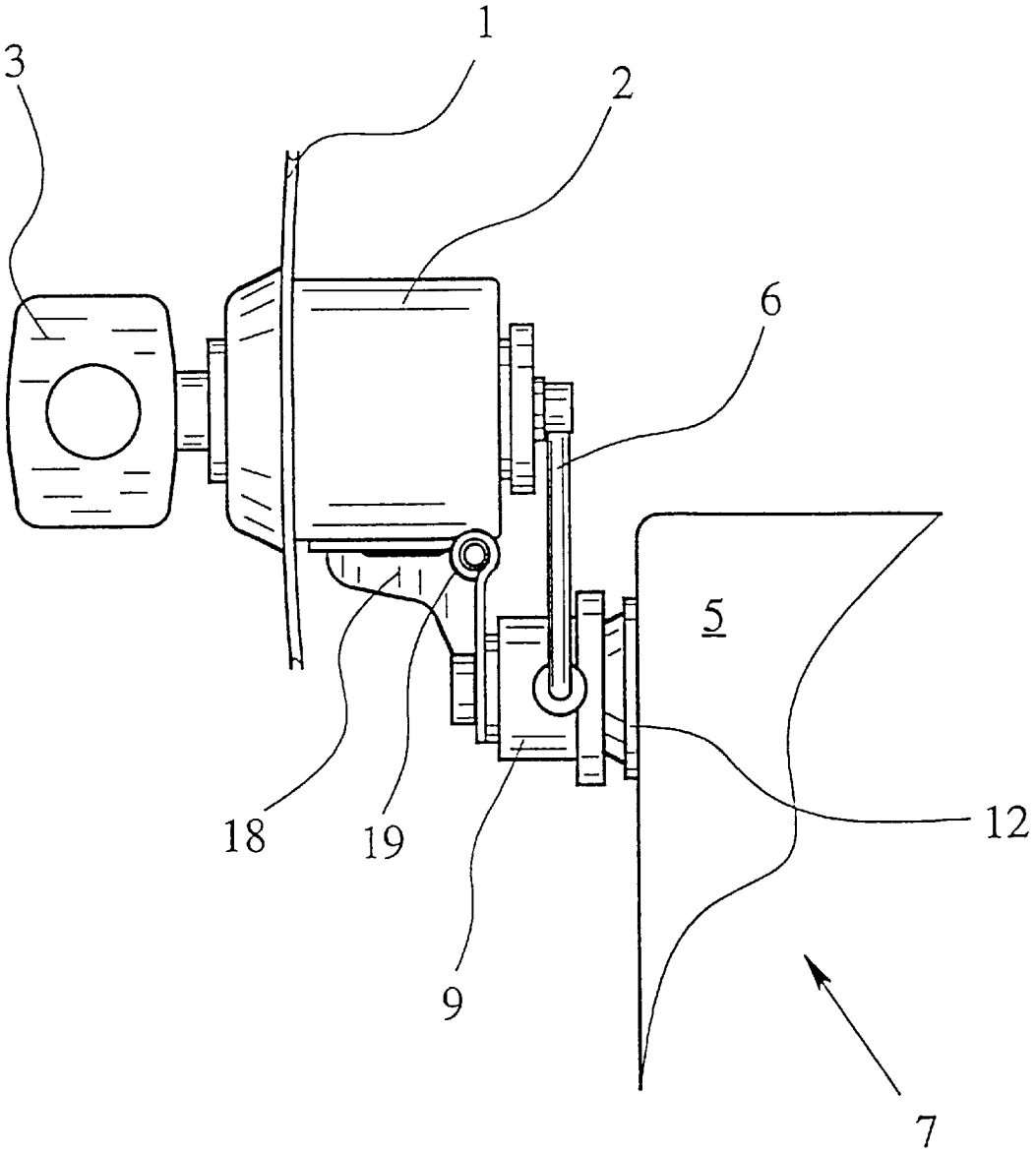
FIG. 2 is schematic illustration similar to FIG. 1, but of a second embodiment of a door lock arrangement as claimed in the invention for motor vehicles.

FIG. 2 shows another embodiment for a door lock arrangement on a motor vehicle door or the like. It differs from the embodiment as shown in FIG. 1*a* in that, here, a coaxial arrangement of closing cylinder arrangement 2 to coupling element 7 of lock mechanism 5 is not necessary. Here, a lateral offset is possible by transfer element 6 extending at an angle, preferably perpendicular, to the longitudinal axis of closing cylinder arrangement 2, to the coupling element 7 which is located offset thereto on lock mechanism 5.

Otherwise, in the embodiment shown in FIG. 2, the "inner life" within nut funnel 9 is shown as in FIG. 1*a*. Additional an adjusting lever 18 which is loaded by a bending spring 19 replaces the compression spring 8 of the transfer element 6 of FIG. 1*a* and may balance tolerances of nut funnel 9 relative to outer nut 12.

The lateral offset in the above described embodiment makes coupling element 7 of lock mechanism 5, for the most part, inaccessible when the closing cylinder arrangement 2 is removed. In this arrangement therefore, under certain circumstances, protection element 17 can be omitted. It is a subordinate achievement of this embodiment which, however, can also be cumulatively accomplished using protection element 17.

While a single embodiment in accordance with the present invention has been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

We claim:

1. A door lock arrangement for motor vehicles wherein the door lock arrangement comprises a closing cylinder arrangement adapted to be attached to an outer sheet metal of a vehicle body in a manner accessible from outside of the vehicle body and a lock mechanism adapted to be attached within the vehicle body in a manner inaccessible from outside of the vehicle body, the closing cylinder arrangement having a transfer element which establishes a connection between the closing cylinder arrangement and the lock mechanism, the lock mechanism having a coupling element which is engaged by the transfer element via a form-fit connection enabling rotary motion of the transfer element to be converted into a corresponding rotary motion of the coupling element and upon forced removal of the closing cylinder arrangement, causing the transfer element to exert an axial force upon the coupling element, said coupling element having means for preventing actuation of the lock mechanism from outside of the vehicle as a result of the axial force applied to the coupling element; wherein the coupling element comprises a two-part nut having an inner nut connected into the lock mechanism and outer nut which is connected to the transfer element and which is coupled to the inner nut; wherein the inner nut and the outer nut are freely rotatable relative to one another; and wherein the inner nut and outer nut are connected in a rotation transmitting manner by means of a member connected to the transfer element.

2. Door lock arrangement as claimed in claim 1, wherein the means for preventing actuation of the lock mechanism from outside of the vehicle as a result of the axial force applied to the coupling element by transfer element comprises said coupling element being constructed so as to be destroyed, modified, or removed in response to said axial force.

3. Door lock arrangement as claimed in claim 1, wherein the connection of the inner nut and the outer nut takes place via a paddle which is inserted into a rectangular opening, the paddle being connected to the transfer element so as to be removed from the rectangular opening upon forced removal of the closing cylinder arrangement; and wherein a protection element is provided which renders the opening inaccessible after removal of the paddle.

4. Door lock arrangement as claimed in claim 3, wherein the protection element comprises a leaf spring.

5. Door lock arrangement as claimed in claim 3, wherein the protection element is located in the outer nut and closes the opening in the outer nut upon removal of the paddle.

6. Door lock arrangement as claimed in claim 1, wherein the coupling element is connected to the transfer element in a manner causing it to be removed from the lock mechanism by the axial force applied by the transfer element due to forced removal of the closing cylinder arrangement; wherein the outer nut of the coupling element has an opening which is provided with a protection element; and wherein the protection element constitutes a means for blocking access to a force transfer point of the lock mechanism vacated by the coupling element; wherein the protection element is supported in the inner nut and closes the opening in the outer nut without affecting rotation of the outer nut relative to the inner nut.

7. Door lock arrangement as claimed in claims 1, wherein a funnel nut is provided on the transfer element.

8. Door lock arrangement as claimed in claim 7, wherein the funnel nut is coupled to the outer nut via a form-fit receiver so as to preclude relative rotational displacement between the funnel nut and the outer nut.

9. Door lock arrangement as claimed in claim 8, wherein the connection of the inner nut and the outer nut takes place via a paddle which is inserted into a rectangular opening, the paddle being connected to the transfer element so as to be removed from the rectangular opening upon forced removal of closing cylinder arrangement; and wherein the funnel nut comprises a catch receiver which lockingly engages with a catch head of the paddle.

10. Door lock arrangement as claimed in claim 7, wherein the connection of the inner nut and the outer nut takes place via a paddle which is inserted into a rectangular opening, the paddle being connected to the transfer element so as to be removed from the rectangular opening upon forced removal of closing cylinder arrangement; and wherein the funnel nut comprises a catch receiver which lockingly engages with a catch head of the paddle.

* * * * *